US008256168B2

(12) United States Patent
Bigger

(10) Patent No.: US 8,256,168 B2
(45) Date of Patent: Sep. 4, 2012

(54) STRUCTURE COMPRISING HEXAGONAL TUBES AND RHOMBOID INSERTS

(76) Inventor: George S. Bigger, Broomfield, CO (US)

( * ) Notice: Subject to any disclaimer, the term of this patent is extended or adjusted under 35 U.S.C. 154(b) by 124 days.

(21) Appl. No.: 12/924,924

(22) Filed: Oct. 8, 2010

(65) Prior Publication Data

US 2011/0086189 A1 Apr. 14, 2011

Related U.S. Application Data

(60) Provisional application No. 61/249,971, filed on Oct. 8, 2009.

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |

(52) U.S. Cl. ..... 52/79.2; 52/79.4; 52/79.5; 52/79.13; 52/585.1; 405/17; 405/114

(58) Field of Classification Search ..... 52/71, 79.1, 52/79.2, 79.3, 79.4, 79.5, 79.13, 284, 585.1, 52/608; 446/108, 109, 117, 124; 405/15–17, 405/111, 114

See application file for complete search history.

(56) References Cited

U.S. PATENT DOCUMENTS

| | | | | |
|---|---|---|---|---|
| 2,235,646 | A * | 3/1941 | Schaffer | 52/585.1 |
| 2,826,906 | A * | 3/1958 | Rice | 52/585.1 |
| 3,395,502 | A * | 8/1968 | Frey | 52/73 |
| 3,510,979 | A * | 5/1970 | Fischer | 446/102 |
| 3,609,926 | A * | 10/1971 | Muse | 52/439 |
| 4,110,949 | A * | 9/1978 | Cambiuzzi et al. | 52/437 |
| 4,115,980 | A * | 9/1978 | Martel et al. | 52/590.2 |
| 4,171,590 | A * | 10/1979 | Fischer | 446/122 |
| 4,172,680 | A * | 10/1979 | Brown | 405/16 |
| 4,372,705 | A * | 2/1983 | Atkinson | 405/19 |
| 4,454,699 | A * | 6/1984 | Strobl | 52/585.1 |
| 4,947,610 | A * | 8/1990 | Koerner | 52/585.1 |
| 5,046,988 | A * | 9/1991 | Bennett | 446/487 |
| 5,771,650 | A * | 6/1998 | Williams et al. | 52/568 |
| 5,778,622 | A * | 7/1998 | Baker | 52/405.3 |
| 6,139,241 | A * | 10/2000 | Craig et al. | 414/287 |
| 6,488,448 | B1 * | 12/2002 | Blomquist et al. | 405/284 |
| 6,641,452 | B2 * | 11/2003 | Racine | 446/122 |
| 6,739,797 | B1 * | 5/2004 | Schneider | 404/35 |
| 7,036,277 | B2 * | 5/2006 | Burginger | 52/79.4 |
| 7,413,081 | B2 * | 8/2008 | Rogers | 206/509 |
| 7,654,776 | B2 * | 2/2010 | MacDonald et al. | 405/284 |
| 7,765,744 | B2 * | 8/2010 | Herron | 52/79.5 |
| 2005/0055980 | A1 * | 3/2005 | Muise | 52/749.1 |
| 2009/0019813 | A1 * | 1/2009 | Korman et al. | 52/745.13 |
| 2009/0113815 | A1 * | 5/2009 | Woodcock | 52/81.1 |

* cited by examiner

*Primary Examiner* — Brian Glessner
*Assistant Examiner* — Adriana Figueroa

(57) ABSTRACT

A structure comprising a plurality of regular hexagonal tubes and a plurality of rhomboid inserts is disclosed. At least one of the tubes can be placed end-to-end relative to another of the tubes in a configuration where the central axes of the tubes are parallel. These central axes can be either collinear or not collinear depending upon the overall configuration of the structure chosen. Each rhomboid insert fits inside at least one section of a hexagonal tube. Those rhomboid inserts that fit into more than one hexagonal tube provide a means for interlocking the tubes.

20 Claims, 20 Drawing Sheets

STRUCTURE COMPRISING HEXAGONAL TUBES AND RHOMBOID INSERTS

This application claims priority based on U.S. Provisional patent application Ser. No. 61/249,971 entitled "Unique Method to form Shaped Structural Containers and Interlocking Infrastructures," filed 8 Oct. 2009.

BACKGROUND OF THE DISCLOSURE

This invention relates to the construction of structures made from interlocking elements or subassemblies that can be fabricated and shipped as components and assembled together on-site for temporary or permanent use. Examples of applications include but are not limited to barricades, barrier reefs, berms, buildings, bunkers, culverts, dams, facades, fencing, fish ladders, foundations, jetties, levees, planters, reinforcement walls, retaining walls, retention ponds, revetments, roadways, sand dunes, scaffolds, seawalls, shoring, shorelines, snow fences, space stations, and streambeds. Examples of fields of use include, but are not limited to agriculture, architecture, civil engineering, construction, emergency management, flood control, horticulture, land management, land reclamation and recovery, military defense, mining, ocean and sea management, shorelines, and water management.

When fabricating such structures in the field it is desirable to have components that are as light as possible and can pack together as easily as possible. Since one wants to ship as little air as possible, it is a benefit to have components that can be packed flat or that nest together and take their final shape when the structure is assembled. To save shipping weight, there is an advantage if some of the bulk can be added from local materials, such as fillers made from water, sand, soil, gravel, concrete or other inorganic or organic substances available near the construction site. Another approach is to have the components be made using simple technologies available almost everywhere, such as the casting of concrete.

It is also desirable to be able to build such structures in varying sizes, shapes, and three-dimensional configurations using as few different components as possible. It is further desirable that such structures require a minimum of skill in the field during the assembly process.

This disclosure presents an approach for building such structures by to placing rhomboid-shaped inserts into hexagonal tubes in an interlocking configuration that can scale from as few as two tubes and five inserts to as large of a structure as might be needed.

BRIEF DESCRIPTION OF THE DRAWINGS

The present disclosure is described in conjunction with the appended figures.

In the appended figures, similar components and/or features may have the same reference label. For items with the same reference label, the description is applicable to any one Of the similar components.

DETAILED DESCRIPTION OF THE PREFERRED EMBODIMENT

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. In other instances, the selection of the manufactured materials for the embodiments is dictated by the intended result, and may vary based on manufacturing specifications, tolerances, and manufacturability practices. For example, the structure comprised of two hexagonal tubes and five rhomboid inserts can be made of separate pieces which when placed together form the hexagonal tube or its rhomboid inserts. The structure can be made in a manner or from products with certain durability, resistance to the elements, and other such design features that may not be included herein. The structure can also be created from components that take other dimensional layouts that are not shaped as hexagonal tubes and rhomboid inserts, but will derive similar structural integrity and enable similar dimensional constructions when installed according to this invention and because of the resulting aligned and interlocked arrangement of those components. The structure can also be configured of skeletal components over which a finish facade can be installed so that the incorporated spaces substantially represent the dimensional arrangements of this invention, and that any internal spaces within that configuration, whether within a given hexagonal tube or between adjacent ones, or within or among any of its rhomboid inserts, can be readily accessed and utilized with minimal interference to that access or usage. The elements of the structure my include manufacturability features such as drafts and tapers to ensure that they can be molded or cast.

Figure 1:
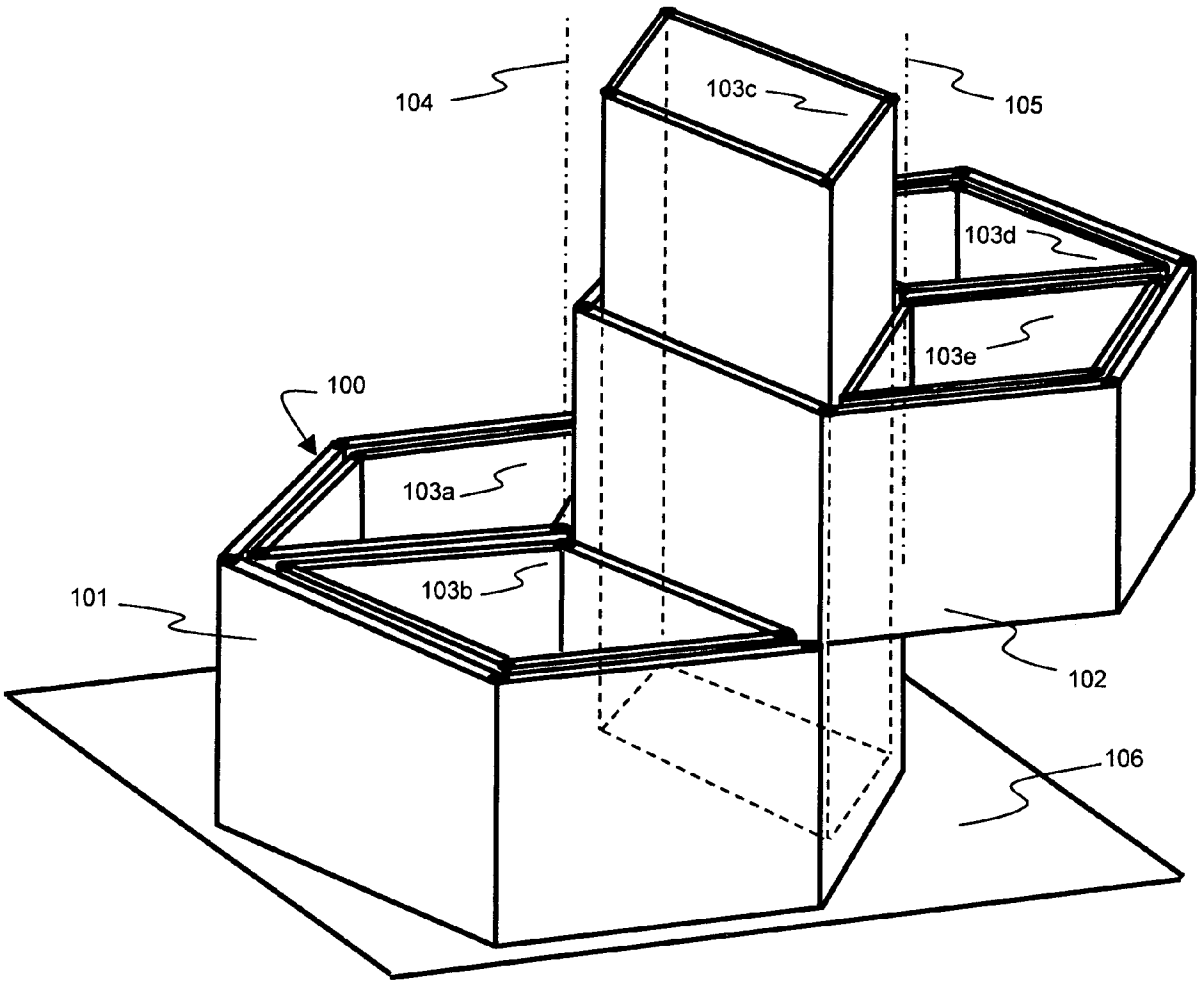
FIG. 1 shows a structure comprising two regular hexagonal tubes and five rhomboid inserts placed on an install surface.

FIG. 1 shows an embodiment of the present invention placed on an install surface. The install surface is shown at 106. A structure is shown at 100. The structure is comprised of a first regular hexagonal tube 101, a second regular hexagonal tube 102, and five rhomboid inserts 103*a-e*. The two tubes, 101 and 102, have central axes, 104 and 105 respectively, that are straight lines. The central axes represent a line corresponding to the center of the tube. The central axes, 104 and 105, are parallel to each another. In this embodiment, the tubes, 101 and 102, are hollow in all cross sections perpendicular to their central axes and are open at both ends. It is possible for the tubes to be hollow in only some cross sections. It is possible for the tubes to have multiple smaller tubular hollows. It is possible for the tubes to be solid in some cross sections and have hollows in others. It is possible for the tubes to have hollows that are like foam in which the hollows are small bubbles. The sidewalls of the tubes 101 and 102 depicted in FIG. 1 are solid flat sheets. These sides can also have holes or be mostly open, making the sidewalls more like a space frame. The tubes have substantially unvarying cross section profiles in all planes perpendicular to their central axes. It is understood that a substantially unvarying cross sectional profiles would include profiles for which the cross-section might be different near the ends or some other section of the walls of the tubes to allow for framing of the tubes or features that allow the tubes to be assembled or attached to other elements of the structure. Substantially unvarying cross section profiles can include profiles that might change due to the need for draft or other manufacturability-related requirements. The tubes can be monolithic or fabricated from multiple elements. The tubes can be rigid or flexible. In the embodiment shown in FIG. 1 the tubes can also be described as being hexagonal prisms.

In the embodiment shown in FIG. 1, the five rhomboid inserts (103*a*,103*b*,103*c*, 103*d*,and 103*e*) have cross-sections perpendicular to their central axes that are similar in size and shape to one another. The exterior shape of the five rhomboid inserts comprises at least one section that is substantially similar to either a rhomboid prism with rhomboid cross sections having 60 and 120 degree interior angles (i.e. a 60/120 degree rhomboid prism) or a rhomboid cone with rhomboid cross sections having 60 and 120 degree interior angles (i.e. a 60/120 degree rhomboid cone). The longitudinal axes of the five rhomboid inserts are parallel to the central axes of the two hexagonal tubes. For this disclosure the longitudinal axis of the inserts shall be defined as the line that runs through the center of the rhomboid cross sections from end to end of the conical or prismatic structure. The rhomboid inserts shown are hollow, and can therefore also be described as being cored, due to having at least one section of their interiors that is filled with something other than the material used for making the insert. It is also possible to have rhomboid inserts that are solid or any variation that is partially solid and partially cored or hollow. The sidewalls of the inserts shown in FIG. 1 are solid. It is also possible to have rhomboid inserts that have holes in their sidewalls as long as the projected view of at least one cross section of the sidewalls contains features defined at their exterior by a rhomboid having 60 and 120 degree exterior angles.

FIG. 1 illustrates that the three rhomboid inserts 103*a*, 103*b*,and 103*c* are at least partially inside the first hexagonal tube 101, and at least one of those three inserts, 103*c* in FIG. 1, is at least partially within the second hexagonal tube 102, serving to align and connect the two tubes in a contiguous fashion. Two other rhomboid inserts 103*d* and 103*e* are within the second hexagonal tube 102, accounting for a total of five inserts 103*a-e* within the structure. The ends of the rhomboid inserts 103*a-e* are preferably not on the same plane as the ends of the hexagonal tubes 101 and 102. By having the ends of the rhomboid inserts and the ends of the hexagonal tubes be in different plane, we can create an interlock between the tubes and inserts. The exposed ends of the inserts create locators for additional tubes and the unfilled sections of the tubes create space for additional inserts, providing a structure that can be expanded endlessly in all directions.

FIG. 1 depicts an embodiment in which the walls of the hexagonal tubes are thin relative to the perimeter of the hexagonal tubes. When thin-walled hexagonal tubes are used to fabricate a structure of the type described, three adjacent rhomboid inserts, such as 103*a-c*, fill nearly all of the cross-sectional space inside an individual hexagonal tube, 101 in this case. Inserts 103*c*,103*d*,and 103*e* do the same for tube 102. Thus, we can say that the inserts substantially occupy the structure.

FIG. 1 shows the structure 100 mounted on an install surface, shown at 106. One can visualize that the first hexagonal tube 101 can be placed on an uneven install surface and the tube 101 then made level by dropping each rhomboid insert 103*a-c* through the hexagonal tube 101 until the inserts contact the install surface 106. Once the first hexagonal tube 101 is placed, the second hexagonal tube 102 can be placed end-to-end relative to the first tube. In the embodiment shown in FIG. 1, the two tubes, 101 and 102, are in an offset alignment. By this, we mean that the central axes, 104 and 105, are parallel but not collinear. As will be shown later in this disclosure, it is also possible to fabricate embodiments of the present invention in which two end-to-end tubes are lined up with their axes being collinear. FIG. 1 depicts an embodiment of the structure in which the central axes of the hexagonal tubes are in a vertical orientation. As will be shown later in this disclosure, it is also possible to fabricate embodiments in which these central axes, 104 and 105, are at other angles, including horizontal.

Further referring to FIG. 1, the offset alignment between the hexagonal tubes is such that one of the six corners of the second hexagonal tube 102 is collinear with the central axis 104 of the first hexagonal tube 101 and one of the corners of the first hexagonal tube 101 is collinear with to the central axis 105 of the second hexagonal tube 102. If the common rhomboid insert 103*c* was not present and one were to look through the end of the first hexagonal tube 101 and second hexagonal tube 102 in the structure 100, the shape the projected open area common to both tubes would be the same as the exterior shape of the rhomboid insert 103*c*,with two of the sides of the rhomboid insert 103*c* being defined by the inside walls of the first hexagonal tube and the other two sides of the rhomboid insert being defined by the inside walls of the second hexagonal tube. Thus, the rhomboid insert 103*c* serves to align the tubes 101 and 102. Because the rhomboid inserts 103 align the hexagonal tubes, it is desirable for rhomboid inserts to not have their ends on the same planes as the ends of the hexagonal tubes. When building structures from large numbers of hexagonal tubes, it is desirable for each rhomboid insert to be as long as possible so as to extend into as many end-to-end hexagonal tubes as possible.

Figure 2:
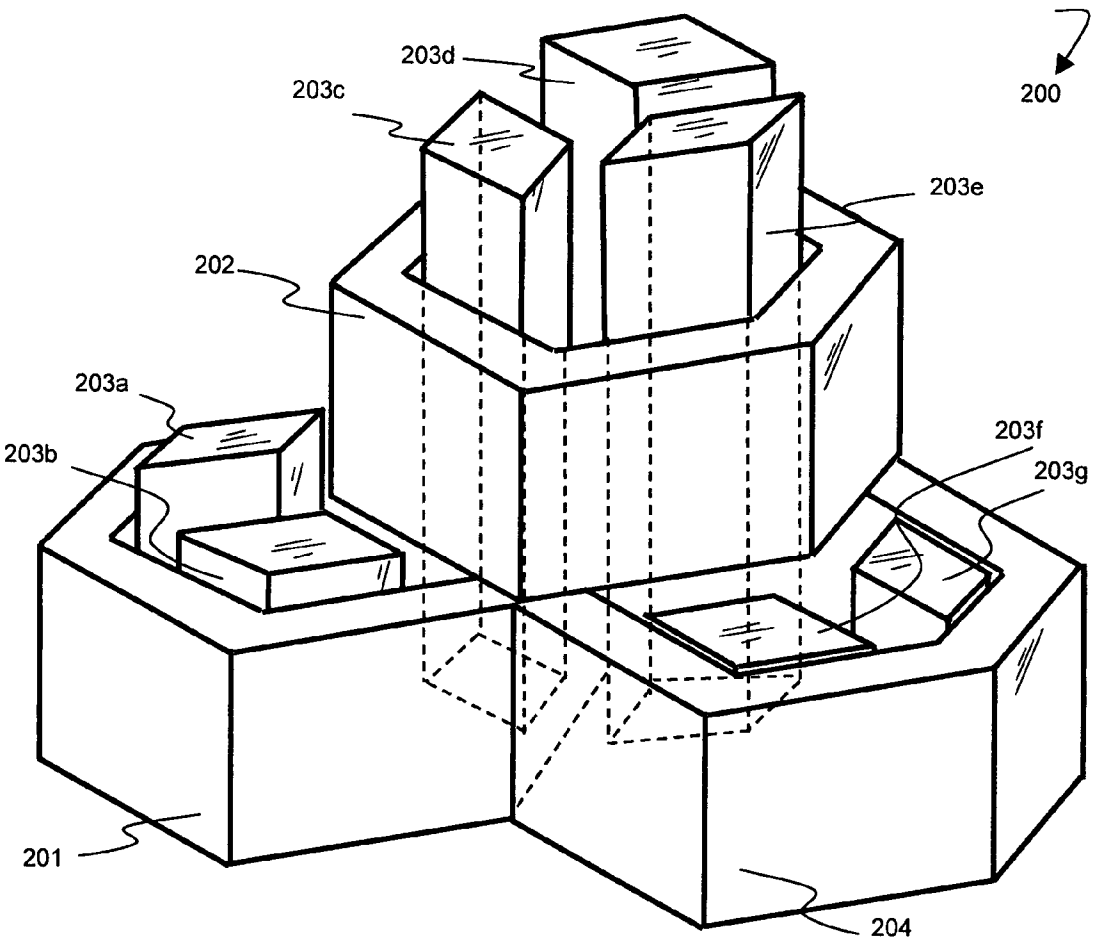
FIG. 2 shows a structure comprising three thick-walled rigid regular hexagonal tubes and seven rhomboid inserts.
Figure 3:
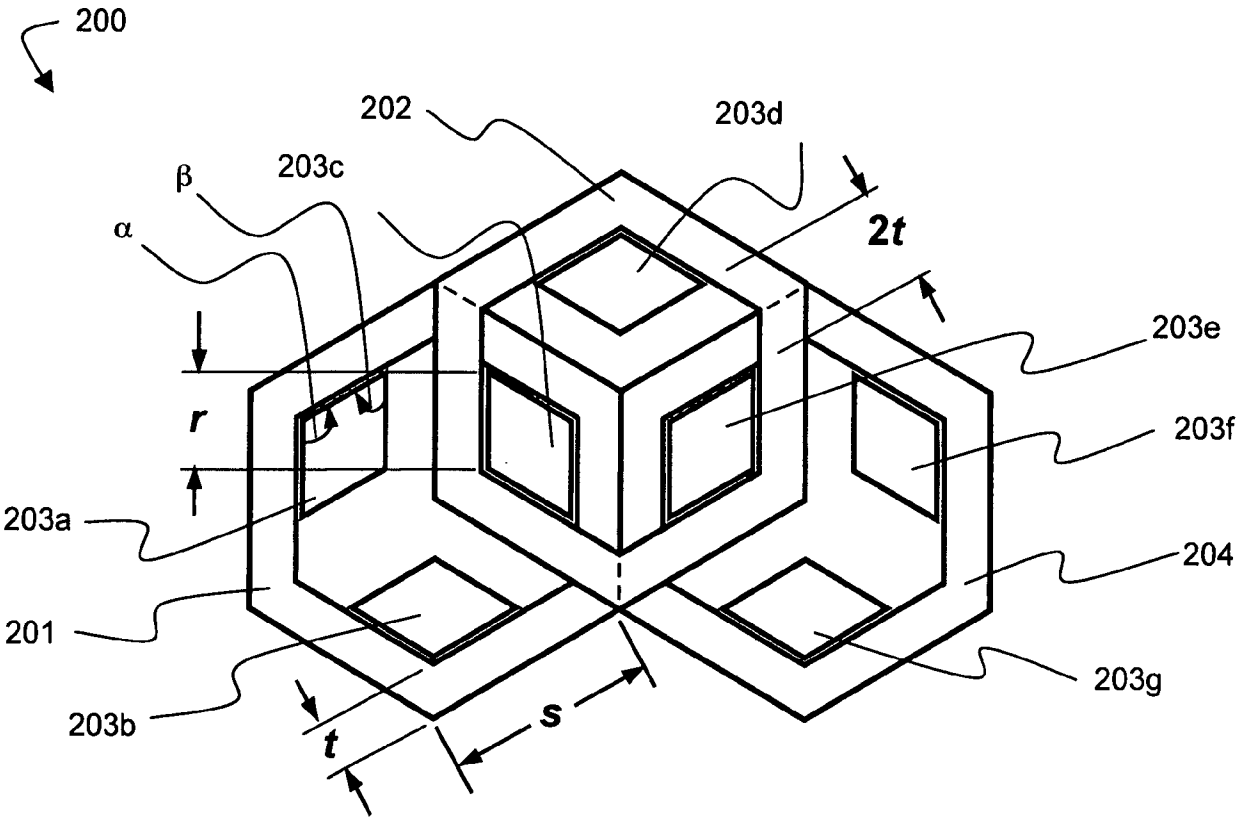
FIG. 3 is the top view of the structure depicted in FIG. 2.

FIG. 2 depicts a variation of the preferred embodiment comprising three hexagonal tubes, shown at 101, 102, and 104, and seven solid rhomboid inserts, shown at 203*a* through 203*g*. In this alternate structure, shown at 200, the regular hexagonal tubes 101, 102, and 104 are depicted as having walls that are relatively thick. FIG. 3 provides a top view of this same structure 200. When the walls of the tubes are made thicker, the spaces between the rhomboid inserts 203*a-g* are greater. These spaces will exist in the center of the tubes when the tubes are placed end to end in an offset configuration. An offset configuration is one in which the central axes of the two tubes are not collinear. The substantially parallel alignment of the longitudinal axes of the rhomboid inserts 203*a-g* is maintained by the alignment of the walls of the tubes in which they occur as shown at 200. The alignment of the inserts serves to address interference that would otherwise occur between the adjacent walls of the first hexagonal tube 201 and third hexagonal tube 202.

Further referring to FIG. 3, the use of thick walls helps to illustrate the alignment between the tubes and inserts. For the tubes and inserts shown in FIG. 3, the top view will be the same as all cross sections perpendicular to the central axis of each tube. If there are variations in the cross sectional profile of the tubes or the inserts, the cross sections perpendicular to the central axis of a tube may be different at different points along the central axis of a tube. Such variations may occur for many reasons capable of being understood by anyone skilled in the art. Examples include draft, which might be needed for manufacturability, and the need for additional geometric features for handling, assembling, or shipping the tubes or inserts.

FIG. 3, also illustrates what is meant in the present disclosure by a 60/120 degree rhomboid prism, 60/120 degree rhomboid cone, and a rhombus having 60 and 120 degree interior angles. The top surface is rhomboid insert 103*a* is shown to have two angles in adjacent corners, labeled $\alpha$ and $\beta$. By definition, a rhombus must have parallel sides, which means that these two angles in adjacent corners must be complementary (i.e. add up to 180 degrees). For a rhombus to fit inside of a regular hexagon, which by definitions has 120 degree interior angles, the angle $\alpha$, which is adjacent to an interior angle of the hexagon, must be 120 degrees. Thus angle $\beta$ must be 60 degrees.

The dimensional size of the sides of the three hexagonal tubes in FIG. 3 is given as s and the thickness of the walls of the hexagonal tubes is given as t. By definition, the perimeter of the hexagonal tubes p (not shown in the figure) is therefore 6s. The dimensional size of the sides of a rigid rhomboid insert that fits snugly through multiple hexagonal tubes oriented end-to-end with respect to each other, shown as r, can be calculated to be:

$$r=s-4t/\sqrt{3}$$

The size of the spaces between rhomboid inserts inside of a hexagonal tube can be seen to be the thickness of two walls of the tubes, or 2t. In order to keep this gap from being too large and for the rhomboid inserts to be too small in cross section, there is a practical limit for the ratio between r and s of approximately 1:2. This 1:2 ratio converts to a ratio of 27.7:1 between the perimeter (p) of the hexagonal tube (equivalent to 6s) and the wall thickness of the hexagonal tubes t. The mathematical formula for calculating this 27.7:1 ratio is:

$$r=s/2=s-4t/\sqrt{3}$$

Solve for s as a function of t:

$$s/2=4t/\sqrt{3}$$

$$s=8t/\sqrt{3}$$

Calculate p as a function of t:

$$p=6s=48t/\sqrt{3}=(27.7)t$$

In order for the similarly-sized rhomboid inserts to fit inside the hexagonal tubes, the perimeter of the rhomboid exterior shape (i.e. 4×the dimension of the each side or 4r) for each rhomboid insert at the point where the rhomboid inserts are adjacent and inside of one of the hexagonal tubes, can be no greater than the dimension given by the following geometric equation:

$$4r\leqq 2(6s)/3-8(t)/(3\sqrt{3})$$

where:

6s is the perimeter of the exterior hexagon made by the hexagonal tube (i.e. 6 times the length of each side; and t is the thickness of the walls of the hexagonal tube.

This geometry and the definitions of r, s, and t are illustrated by FIG. 3.

By examining FIG. 1, FIG. 2, and FIG. 3, one can see that the inside walls of two hexagonal tubes placed end-to-end in an offset configuration that share a rhomboid insert will touch opposite side walls of the shared rhomboid insert. This is part of a consistent pattern of how the inserts are placed in structures described by the present invention. If we define two tubes who sidewalls are adjacent as being on the same layer (or course) and we define two tubes that are located end-to-end as being on different layers (or courses) we can see that the location of rhomboid inserts inside any hexagonal tube in one layer (or course) will be reversed (left to right/mirror image) in the next layer (or course) of hexagonal tubes. Strict adherence to a pattern established by the first layer or course of tubes is a preferred way of managing the configuration of multi-tube assemblies of hexagonal tubes whose installation may begin at distant points and converge toward a common point of connection between the approaching segments.

Referring to FIG. 1 and FIG. 2 and FIG. 3, hexagonal tubes can be stable alone will become more stable when placed adjacent to each other in a horizontal configuration. This stability is more fully realized when the hollow or hollows in the hexagonal tubes 101 are substantially filled with rhomboid inserts (103*a*,103*b*,etc) in an interlocking configuration.

Figure 4:
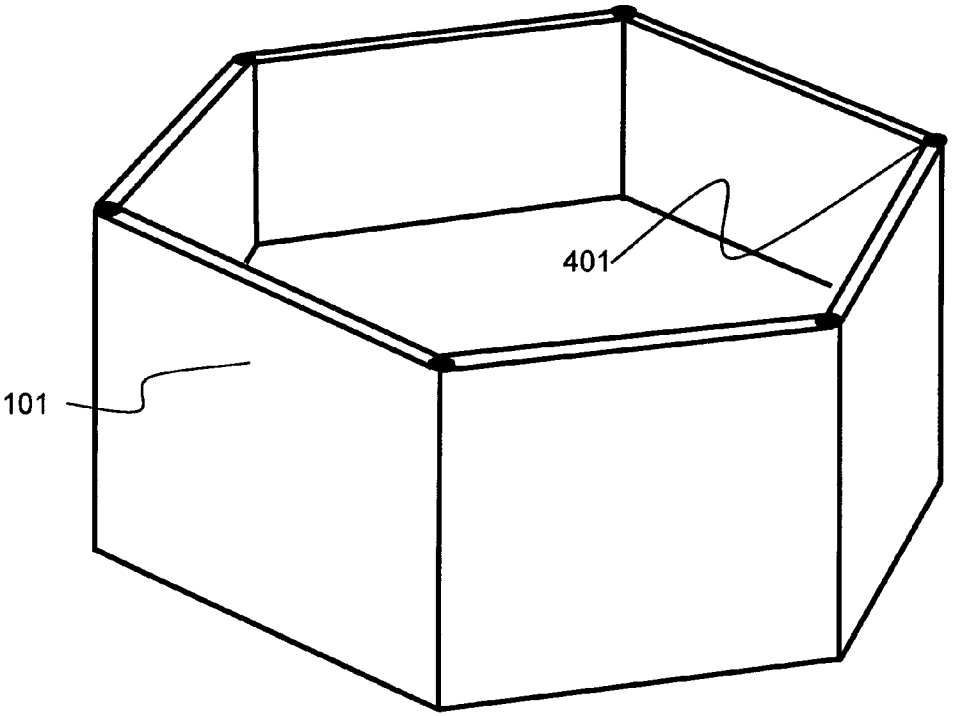
FIG. 4 is a foldable hexagonal tube.

FIG. 4 shows more detail of a typical regular hexagonal tube 101 that had also been shown in FIG. 1. The tube 101 is open on both ends, has a hollow regular substantially hexagonal center, has a substantially constant wall thickness, and the ratio of the outside perimeter to wall thickness is greater than 27.7 to 1 for all cross-sections of the tube. This tube is comprised of six rigid rectangular panels flexibly attached to one another. The tube shown in FIG. 4 is foldable.

Also referring to FIG. 4, the hexagonal tube is made with substantially parallel vertical walls, which may also incorporate a geometric design feature for ease of installation or for establishing the fit between the hexagonal tube 101 and its rhomboid inserts. FIG. 4 depicts a foldable version of the hexagonal tube 101 that is either hinged 401 at the wall intersections or fabricated of pliable material, or incorporates a design feature so that it can be packed flat. It is understood that the hexagonal tube 101 may first be established by skeletal structure that defines the architectural dimensions that may then be overlain with a facade to be easily recognized as a tubular shape. The hexagonal tube can also be fabricated as separate components which when adjoined create the hexagonal tube represented in FIG. 4.

Figure 5:
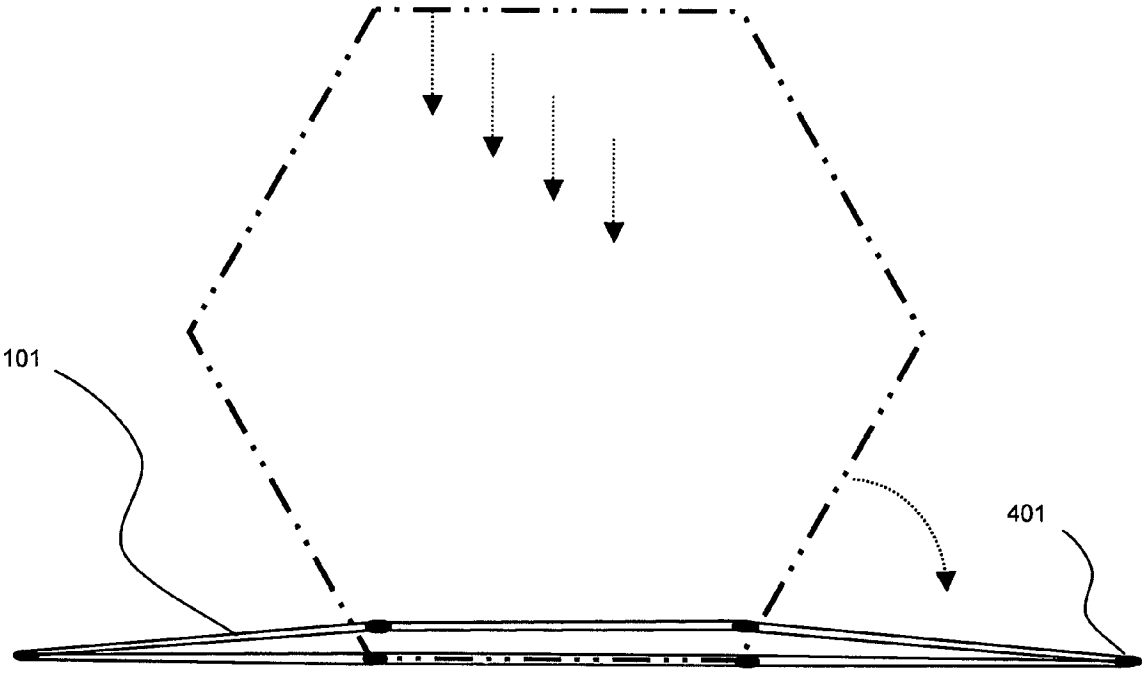
FIG. 5 is the tube of FIG. 4 in a collapsed position.

FIG. 5 shows the hexagonal tube 101 that had previously been shown in FIG. 1 and FIG. 4, in a collapsed configuration. This is an example of the construction and features of a foldable regular hexagonal tube 101 that can be used in the present invention. In this example, the tube 101 has been fabricated in a way that allows it to be folded flat for storage and transport, and then opened up and deployed at the location where it will be installed. In one instance the material can be pliable and able to be folded at any of the six lines 501 where two sides of the hexagonal tube intersect. In another variation, a hinge mechanism may provide this feature at any or all intersections of the hexagonal tube 101 walls. In another example, the hexagonal tube 101 may be fabricated in segments (ex: incorporating only two of the six walls) that can be stacked in a nested or other compact manner.

Figure 6:
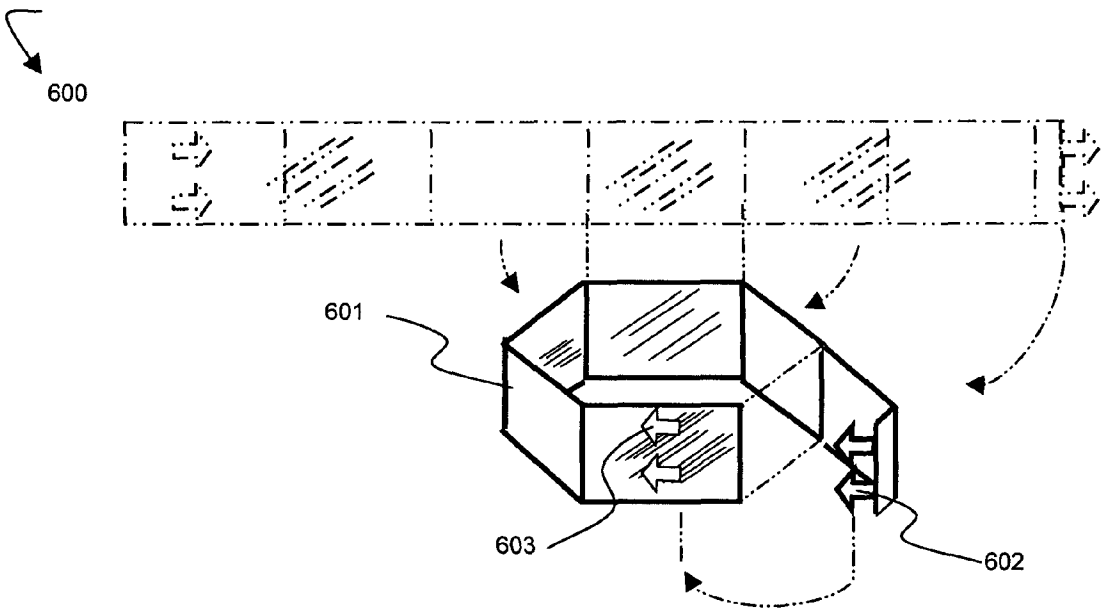
FIG. 6 is a foldable hexagonal tube.

Referring to FIG. 6, a foldable hexagonal tube 601 is shown at 600. In this instance the fabrication is shown as tin or flexible material that can be made to fold at a repeating distance along the length of the material. Those fold points will become the corners of an assembled hexagonal tube. In this example, the material also incorporates a coupling device, shown in FIG. 6 as a pair of a male coupling elements 602 that can be inserted into a female coupling elements 603, to connect the two ends of the material and form the perimeter of a hexagonal tube. This example represents an advantage in manufacturing cost, shipping weight, and simplicity of installation.

Figure 7:
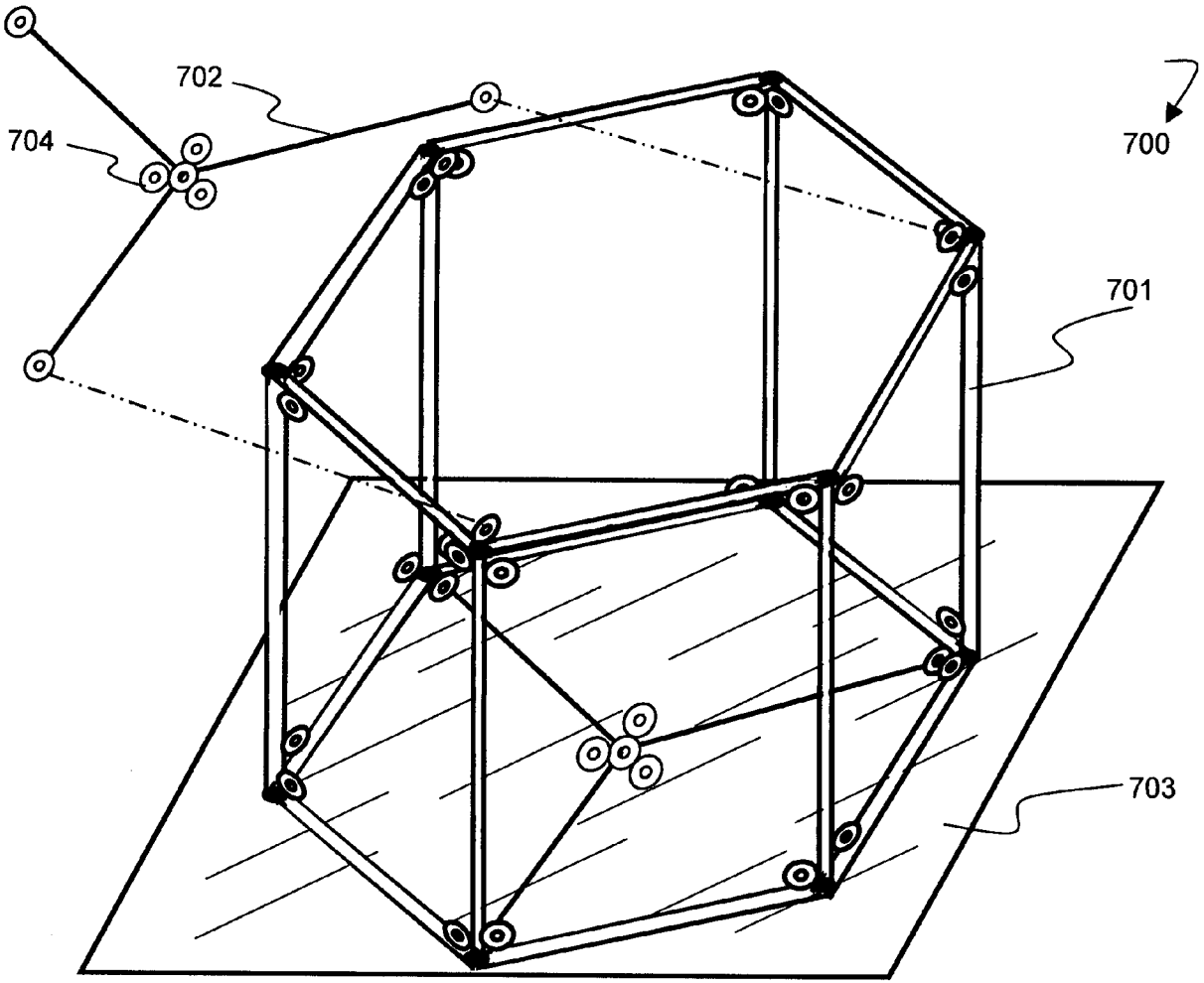
FIG. 7 is an open frame hexagonal tube.

Referring to FIG. 7, an open frame hexagonal tube is shown at 700. This hexagonal tube 700 can also be called a space frame hexagonal tube. The hexagonal tube is shown at 701 and in this example is represented as a frame 701 and a tri-directional spacer 702 with a means 705 for coupling these two components together to form the geometry of the intended shape to be placed on an install surface 703. The coupling device 705 shown in 700 is generic in nature and represents a variety of means that are suitable for joining two components. In this example, a simple washer 705 is shown that would occur on the structure at each potential connecting point and be aligned to a connecting point on any adjacent component.

A bolt can be inserted through the two aligned connecting point washers and a nut tightened onto the bolt to complete the join. For example, a tri-directional spacer 702 is shown as poised to be joined in this manner.

Also referring to FIG. 7, in this instance, wall surfaces are absent. The opportunity in this example is to provide access to and through any space within the configuration of assembled tubes. Wall surfaces can be attached to any frame element to create separation or closure (ex: floor, wall, ceiling). A wall surface will also provide added structural support.

Figure 8:
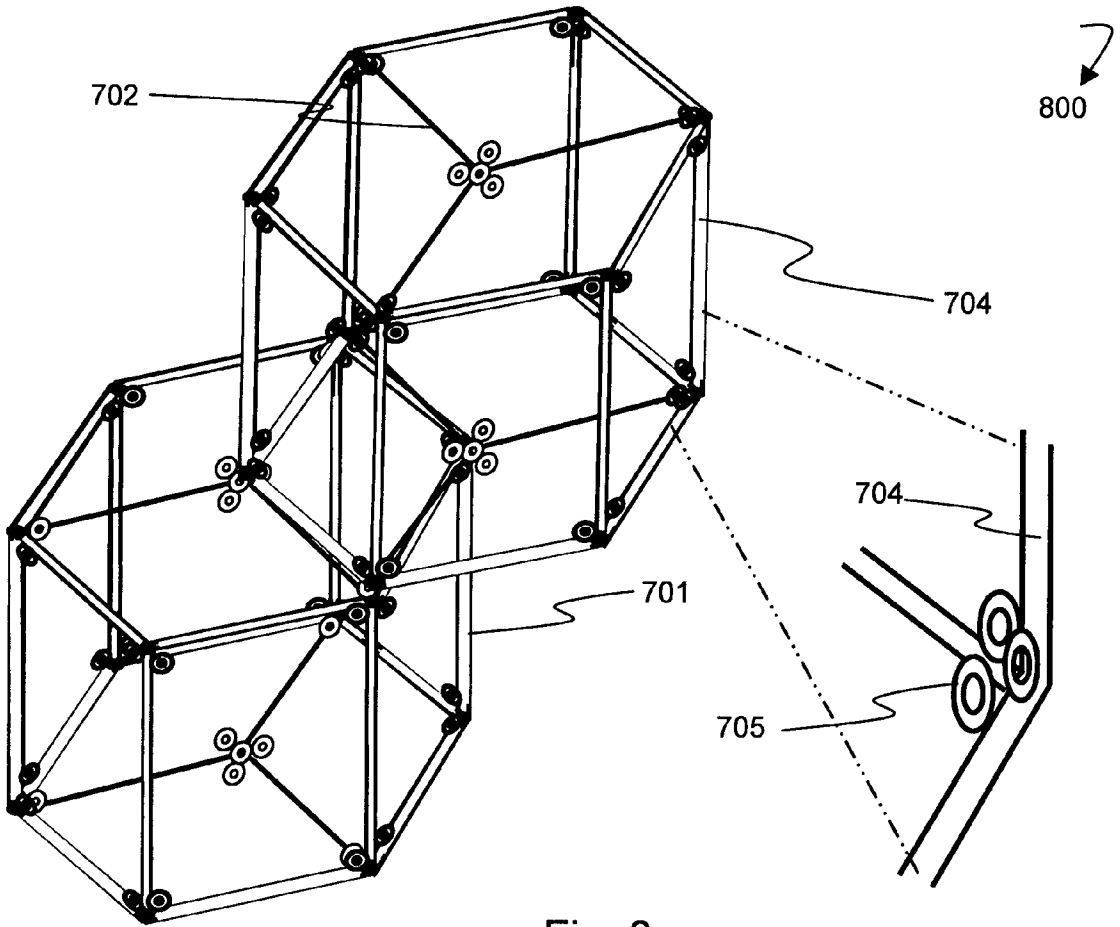
FIG. 8 is an assembly comprising multiple open frame hexagonal tubes.

Referring to FIG. 8, an assembly of open frame (or space frame) hexagonal tubes 701 and 704 is shown at 800. This illustrates the ability to configure multiple tubes in an endless and repeating configuration, and to enable access to and through this assembly of multiple tubes. The frame of the open hexagonal tube 701 repeats the elements of the hexagonal tube 101 shown in FIG. 1. The tri-directional spacer element 702 repeats the configuration established by the rhomboid inserts 103*a-e* as shown in FIG. 1. The framework created by two hexagonal tubes establishes the spatial elements represented in FIG. 1 and the structural interaction that occurs between them when joined together.

Wall surfaces are absent in the open frame assembly illustrated by FIG. 8. It is understood that wall surfaces can be attached to any frame element to create separation or closure (ex: floor, wall, ceiling). Installation of any wall surface can provide structural support. This example demonstrates an opportunity to provide structural design strength and function with minimal components and minimal labor. This embodiment has application for scaffolding in areas such as construction and for expansive workstation architecture in areas such as outer space, for example. The modular framework components can also be fitted with other male-female coupling designs similar in function to that shown on the removable web in FIG. 14.

Hexagonal tubes can be made in other collapsible configurations. By collapsible, we mean any configuration in which the hexagonal tube takes less space when being shipped than it will take in its deployed form. We can also refer to such a configuration that takes less space as a configuration in which the tubes (which can also be referred to as prisms) are tightly packed. For example, this can include configurations in which the walls of the tube have been disassembled into pieces that lay adjacent to each other during shipping, to later be reconfigured when a kit comprising the rhomboid inserts and hexagonal tubes is assembled on-site. It can include a foldable hexagonal tube as described in FIG. 4 and FIG. 5. It can include the foldable hexagonal tube with coupling elements described in FIG. 6. It can include a space frame or open frame hexagonal tube as described in FIG. 7 and FIG. 8.

Figure 9:
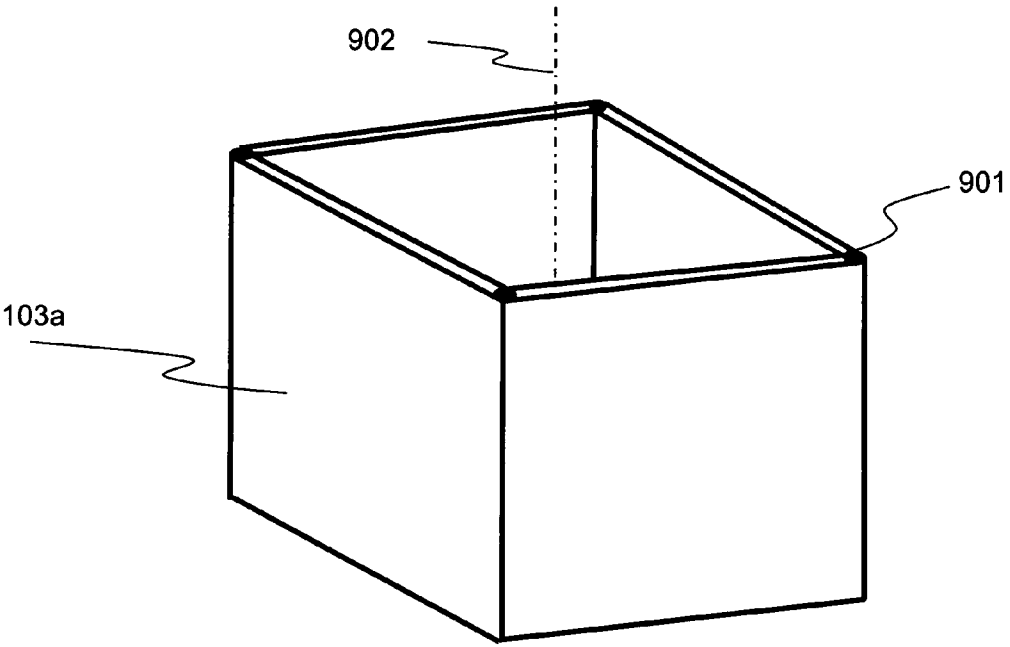
FIG. 9 is a foldable rhomboid insert.

Referring to FIG. 9, a foldable rhomboid insert 103*a* is shown with one of its four folding points indicated at 901. The longitudinal axis of the rhomboid insert is shown at 902. For purposes of the present disclosure a longitudinal axis of a rhomboid insert is defined as the axis coincident with the central axis of a cylindrical tube placed round a rhomboid prism when the sides of the prism are placed inside the cylindrical tube or the axis coincident with the central axis of a hollow cone when a rhomboid cone is placed inside a hollow cone. Three rhomboid inserts can divide the interior of a hexagonal tube space into three substantially equal areas and establish a structural element created by the alignment of the common walls of the rhomboid inserts. If the hexagonal tube is flexible, the shape of a hexagonal tube FIG. 4 can be fully realized when it is substantially filled with three rhomboid inserts such as 103*a*.

Also referring to FIG. 9 the rhomboid insert 103*a* can have a length adequate to always be present in more than one of the end-to-end and offset hexagonal tubes that are adjacent to it. It is by means of the multi-component alignment process (repeated for each of three such rhomboid inserts 103*a* that project into multiple hexagonal tubes 101 (above/and or below) that the already stable hexagonal tube 101 becomes interlocked as it is placed contiguously end-to-end with another tube and over any expanse of multiple hexagonal tubes assembled together in this manner. External forces are thus resisted by the interlock feature that accrues among and between these interlocked hexagonal tubes 101, that each benefit from all adjacent interlocked units.

Rhomboid inserts can be made in other collapsible configurations. By collapsible, we mean any configuration in which the rhomboid insert takes less space when being shipped than it will take in its deployed 60/120 degree shape. For example, this can include configurations in which the walls of the insert have been disassembled into pieces that lay adjacent to each other, to later be reconfigured when a kit comprising the rhomboid inserts and hexagonal tubes is assembled on-site. It can also include a foldable rhomboid insert as described in FIG. 9.

Figure 10:
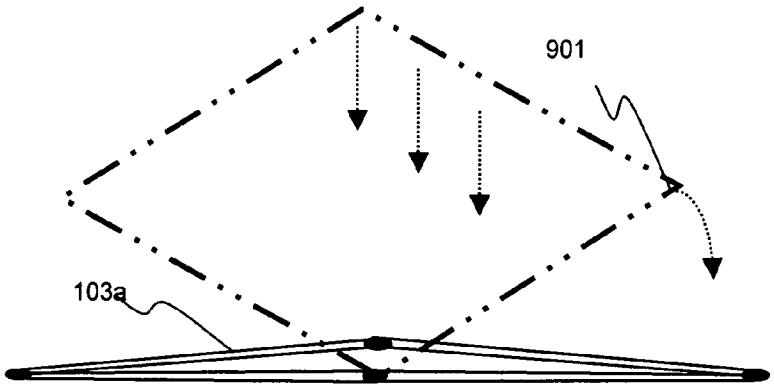
FIG. 10 is the insert of FIG. 9 in a collapsed position.

Referring to FIG. 10, foldable rhomboid insert is shown. One embodiment of the rhomboid insert is accomplished by fabrication in a manner that the spacer can be folded for storage and transport, to be later deployed and placed into a hexagonal tube. In one instance the material can be pliable 901 and able to be folded at any of the four points around the rhomboid insert. In another instance, a hinge mechanism 901 may provide this feature. In another example, the rhomboid insert may be fabricated in segments (for example: incorporating only two of the four walls) that can be stacked in a nesting or other compact manner.

Figure 11:
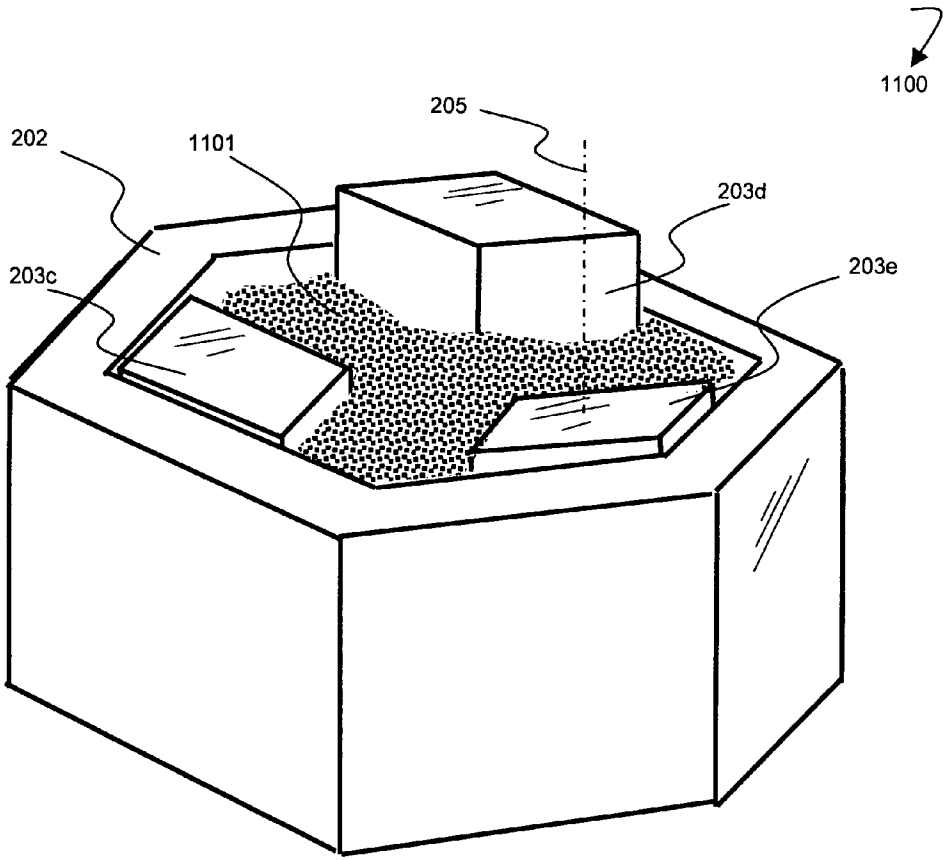
FIG. 11 is a rigid hexagonal tube containing three rigid rhomboid inserts and granular fill material in the space between the inserts.

Referring to FIG. 11, a hexagonal tube, with granular free-flowing filler material 1101 between the three solid rhomboid inserts 103*c-e*,is shown at 1100. This gap or space between the inserts within the hexagonal tube can also be filled with a spacer element made from a solid material or made from a material that hardens after being placed within the gap, space, or voids. Filling the gap between the rhomboid inserts 103 establishes a visual 'channel' to guide placement of the next end-to-end course of hexagonal tubes 101. The rhomboid spacer element minimizes the gap or void or space between all inserts within the hexagonal tube to minimize movement between these parts, and thereby any assembly of multiple hexagonal tubes. This approach, using granular material, would be useful for erosion control applications where a more permanent feature is desired, and especially where granular fill materials are already present (ex: beach sand, river rock, hillside soil). Where tubes are offset and a portion of the insert is exposed, it can offer a medium that could support vegetation—or ensure drainage, depending on the material of choice and desired results. In another instance where a more permanent feature is desired, the filler material that hardens in place to create a highly resistant structure (concrete, for example).

Figure 12:
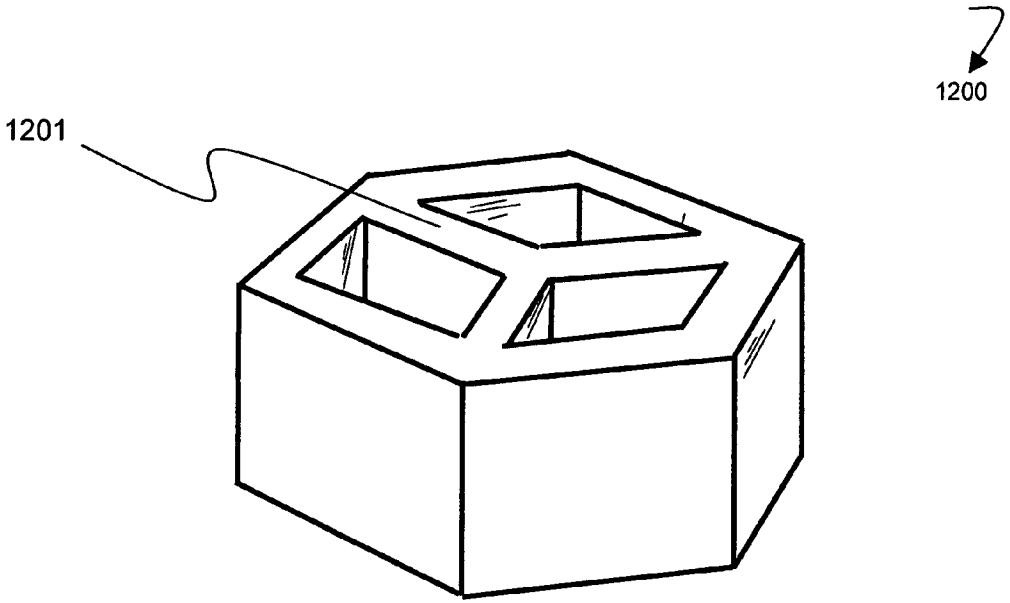
FIG. 12 is an isometric view of a rigid hexagonal tube having a tri-directional web.

Referring to FIG. 12, a rigid hexagonal tube with a tri-directional spacer element 1201 included is shown at 1200. This example provides for the presence of a fixed structural internal web to define and support the hexagonal tube shape and to fill the gap between the insert elements. This built-in web also establishes the orientation of the placement of rhomboid inserts within the hexagonal tube and between adjacent tubes.

Figure 13:
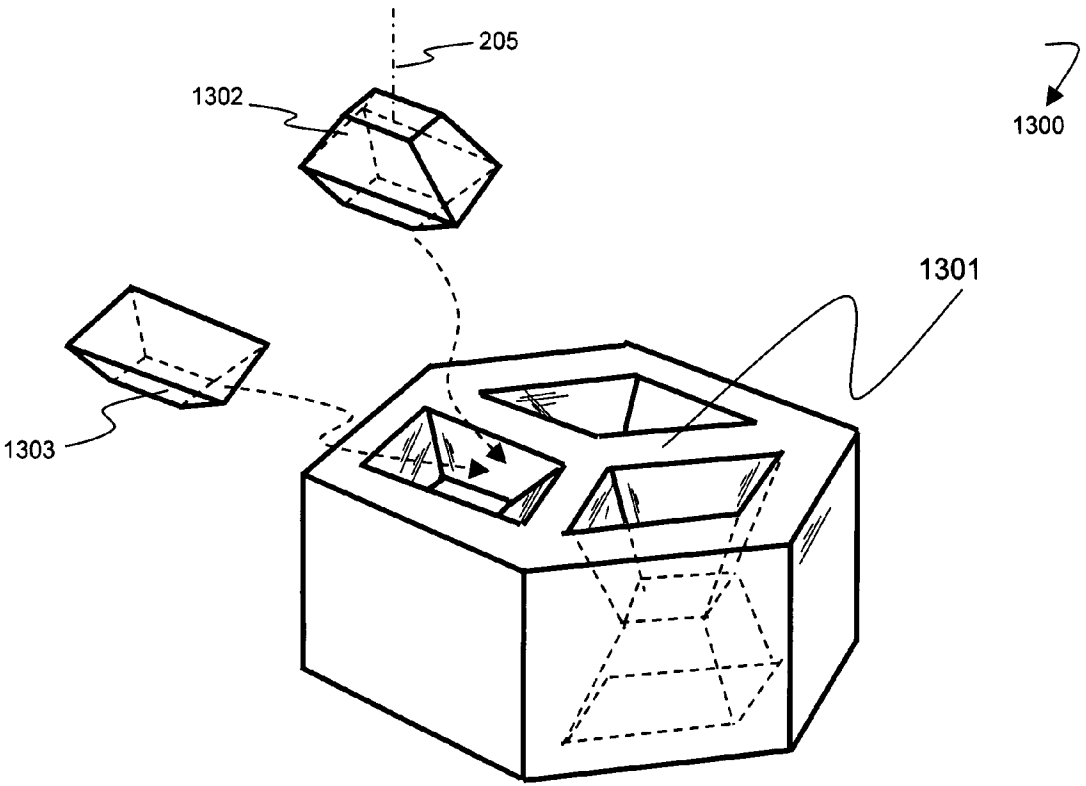
FIG. 13 is an exploded view of a rigid hexagonal tube with a tapered rhomboid cone insert (2 variations)

FIG. 13 shows an exploded view of a rigid hexagonal tube 1301. The tube has a multiplicity of hollows. A rhomboid insert, shown at 1302, is positioned for insertion into one of the hollows in the tube 1301. The insert 1302 is comprised of two 60/120 degree rhomboid cones. The insert has a longitudinal axis shown at 205. It can be visualized that a double-tapered insert of the type shown here can be used to align and interlock the tube 1301 with other similar tubes. If a flat topography across the finish end of the tube is desired, a. single-tapered conical insert shown at 1303 can a substantially flush surface across the exposed face of the tube and the insert. Assembly of this example of the tubes will follow as installation sequence that is similar to all other versions of the tube and insert system, the primary difference being a conical rhomboid shape of the insert. The insert 1302 shown in this diagram is in the shape of two 60/120 degree rhomboid cone.

Figure 14:
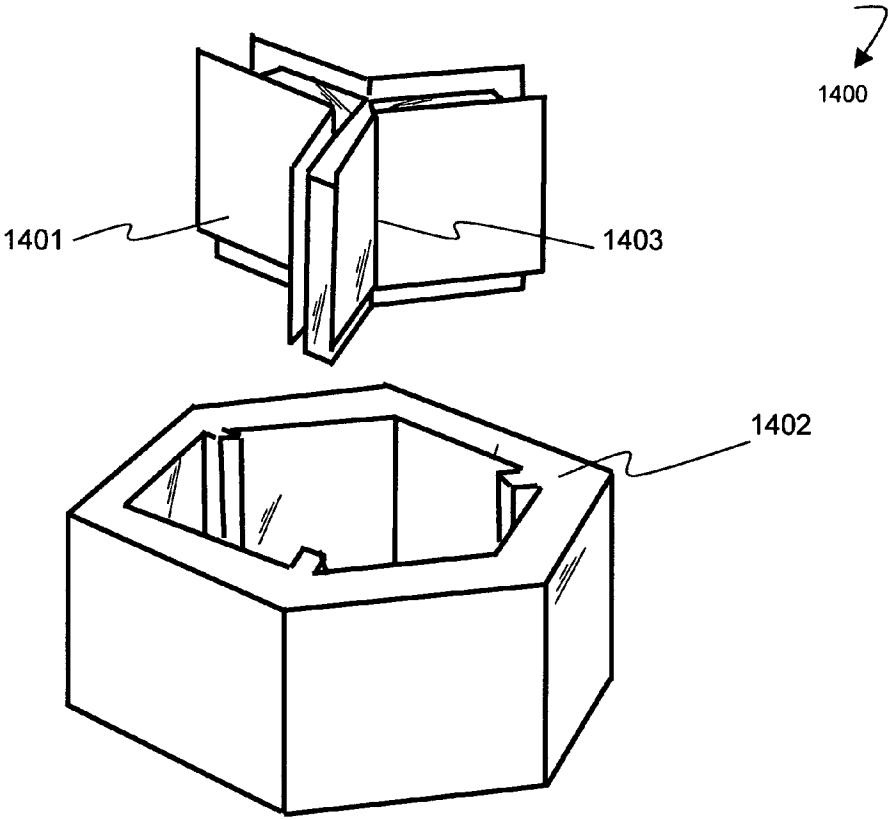
FIG. 14 is an exploded view of a rigid hexagonal tube with a removable tri-directional web.

Referring to FIG. 14, an exploded view of a rigid hexagonal tube 1402 with a tri-directional removable spacer element 1401 positioned for insertion is shown at 1400. In this instance it is expected that assembly of the tubes will require the spacer element to be absent until final placement for field use. This type component would be useful in an application such as culverts where the tubes could be laid horizontally and the spacer elements then installed for added strength. In another instance, it could be useful where the spacer is an element in a skeletal version of the tube and insert system. The removable spacer element can also be fabricated to fold at a hinge point that is shown at 1403 in this example. The spacer can also have a means of aligning to adjacent removable spacers as depicted it 1401.

Figure 15:
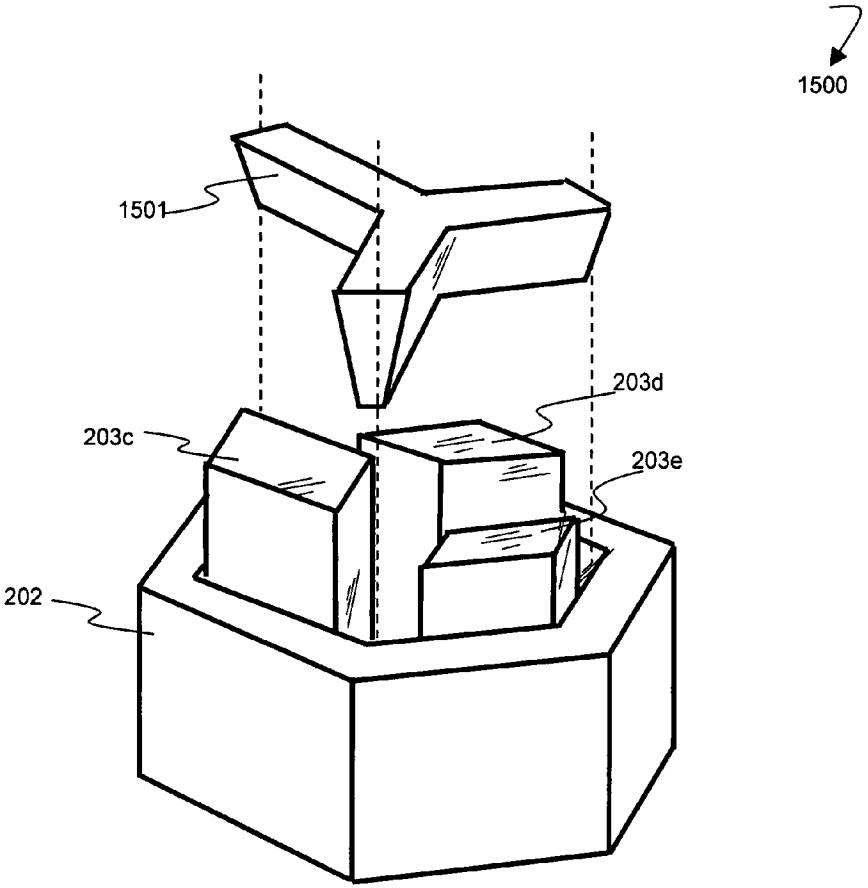
FIG. 15 is an exploded view of a rigid hexagonal tube with a tri-directional spacer poised for insertion between three rigid rhomboid inserts.

Referring to FIG. 15, an exploded view of a rigid hexagonal tube 202 with a tri-directional spacer 1501 positioned for insertion between three rigid rhomboid inserts 203*c-e* is shown at 1500. In this instance it is expected that adjacent hexagonal tubes will be present to engage the rhomboid inserts and in so doing to push the inserts toward the corner of the hexagonal tube in which they occur. It is also expedient to minimize any misalignment or potential for units to shift. A substantially consistent space (which can also be referred to as a gap or void) within the hexagonal tube 202 is created between the parallel common surfaces of the three rhomboid inserts. That space can be filled to minimize shift or alignment issues.

Figure 16:
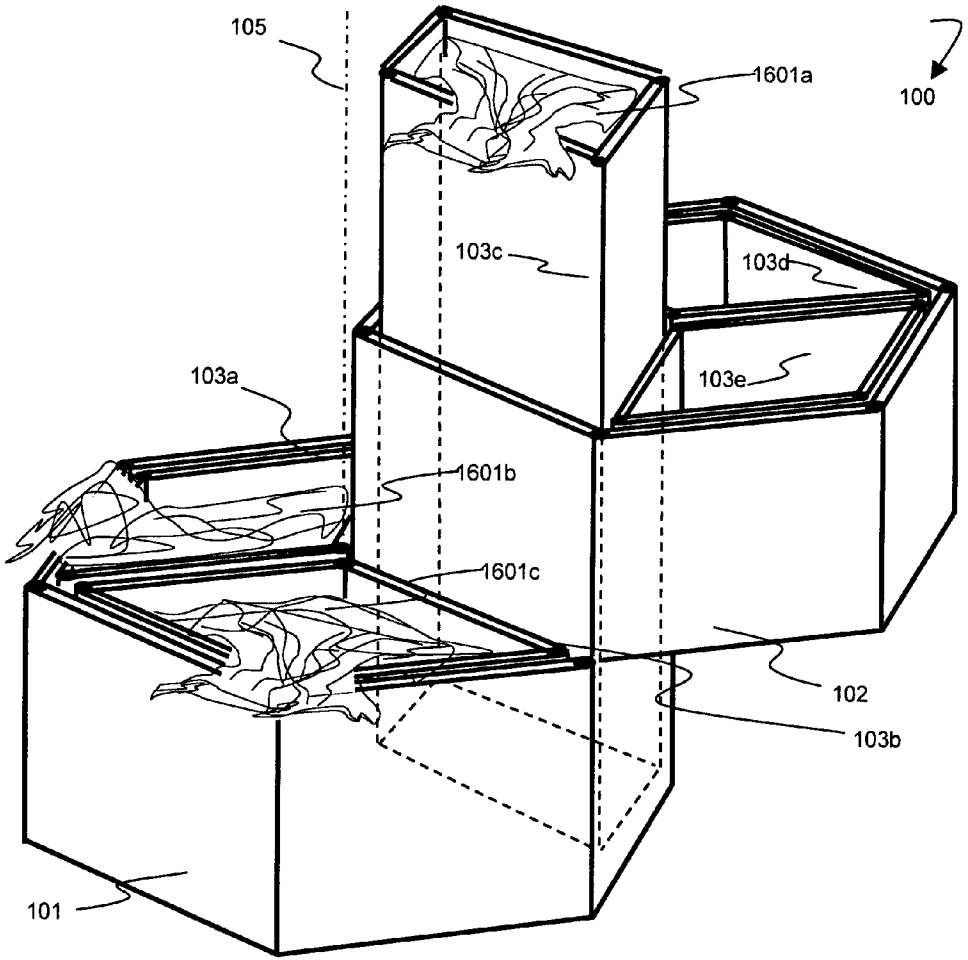
FIG. 16 is a structure comprising two hexagonal tubes, five rhomboid inserts, and viscous filler material placed in three of the inserts.

FIG. 16, shows an alternate embodiment, 1600, of the invention depicted by FIG. 1. In this alternate embodiment, 1600, the cored volumes of the rhomboid inserts 103*a-e* have been filled with a free-flowing material in a leak resistant membrane, shown at 1601*a-c*. The material, 1601*a-c*,can facilitate the stiffening and interlocking of the structure by generating lateral pressure to stabilize the hexagonal tubes 101 and 102 as they work together as well. This continuous vertical core within an open rhomboid insert also provides a structured containment that can hold free-flowing materials like liquids, given the presence of leak-resistant membrane within the confines of the rhomboid insert 103*a-c*. While it is expected that more appropriate designed membranes may be specified (based on desired results, then-current standards of practice, or available materials for fabrication), it is also expected that any of several simple membranes (ex: plastic trash bags or leaf bags) will suffice since substantially all pressure, including water column, which is transferred directly to the install surface (which in many applications will be the ground/earth) and is managed by the combined work of the adjacent and interlocked rhomboid inserts (103*a-c* in this example) that are also confined within interlocked hexagonal tube structures. It is understood that the free-flowing material in the membrane 1601*a-c* could also be replaced with a free-flowing material that hardens or a solid material.

Figure 17:
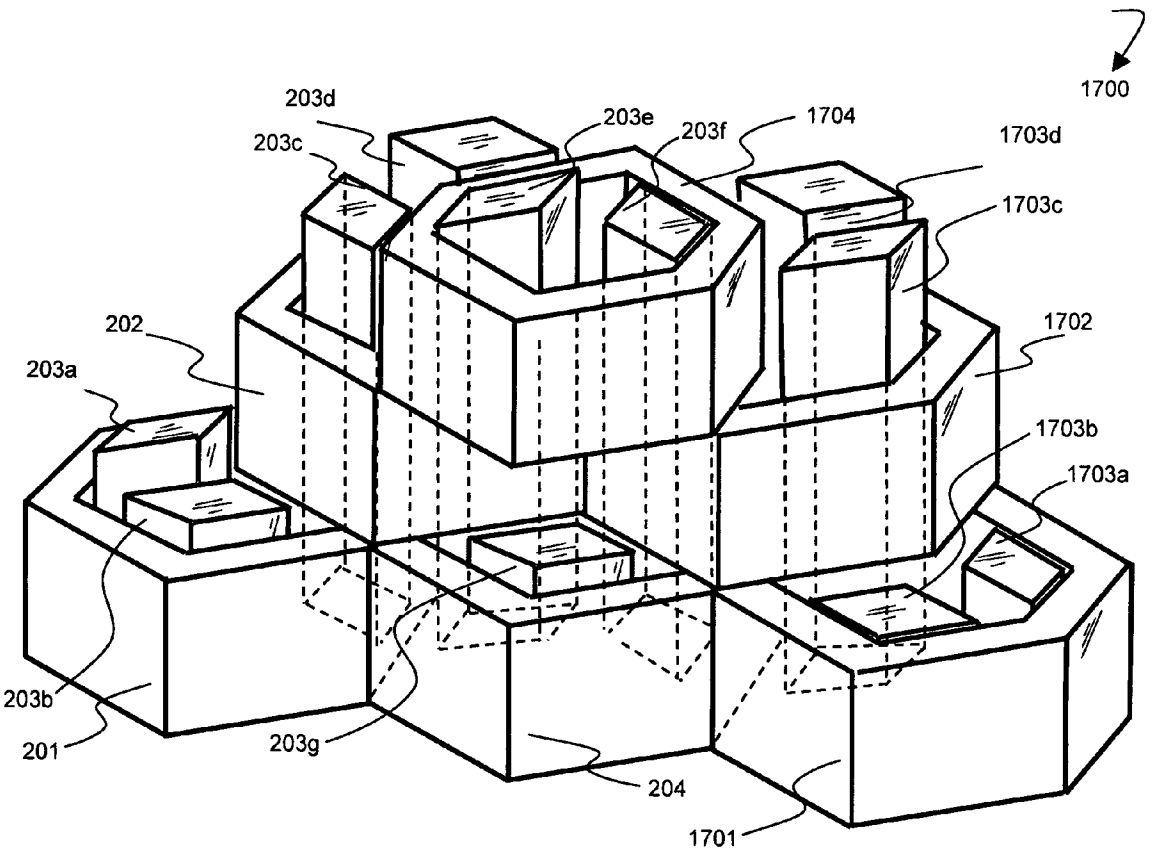
FIG. 17 is a structure comprising six thick-walled rigid regular hexagonal tubes and eleven rhomboid inserts in a three-level configuration.

Referring to FIG. 17, a three-layer structure comprising six thick-walled rigid hexagonal tubes and eleven rhomboid inserts is shown at 1700. This three-layer-structure is similar to the structure shown in FIG. 2 and includes additional tubes and inserts shown at 1701-1704 wherein 1701, 1702, and 1704 are additional hexagonal inserts and 1703*a*, 1703*b*, 1703*c* and 1703*d* are additional rhomboid inserts. The total of six hexagonal tubes, shown at 201, 202, 204, 1701, 1702, and 1704 are distributed across three layers with 201, 204 and 1701 being on a first layer, 202 and 1702 being on a second layer, and 204 being on a third layer.

The embodiment shown in FIG. 17, this example demonstrates the interlocking feature of the inserts, both vertically and horizontally. It also demonstrates the spaces (voids or gaps) that occur between adjacent rhomboid inserts when the inserts and tubes are rigid. In this instance, the inserts are long to show the interaction between the inserts and tubes. FIG. 17 also shows the placement of inserts placed into hexagonal tubes in a configuration so that the central axes of the tubes are parallel with the longitudinal axes of the inserts.

Referring to FIG. 1, FIG. 2, and FIG. 17, the installation process begins with the starting (lowest) elevation on which the hexagonal tubes are to be positioned and the placement of the first hexagonal tube (201 in this example). Rhomboid inserts are then placed in each of the starting (lowest) level layer of hexagonal tubes 201 and 204. Additional hexagonal tubes on all layers or courses are placed immediately adjacent to each other for the expanse of that course. Adjacent hexagonal tubes placed in a lowest level elevation 201 of the installation are made level to each other by means of the rhomboid inserts 203*a-g* that also serve as tripod leveling 'legs'. When the change in the elevation of the topography exceeds the wall height of the hexagonal tube 201 being installed, the next course of hexagonal tubes 202 is established at that upper elevation 202 atop the lower elevation 201 or course of hexagonal tubes. The rhomboid inserts 203*a-g* from the course of hexagonal tubes 201 below establish the pattern of the rhomboid inserts 1703*a-d* and all subsequent courses of hexagonal tubes above the starting (lowest) course 201.

Referring to FIG. 1, FIG. 2, and FIG. 17, all courses above the lowest (starting) course 201 begin with the placement of an upper course hexagonal tube 202 such that one longitudinal axis at one of its corners 205 aligns vertically with the center point of an adjacent hexagonal tube immediately end-to-end with the tube (1701 in this example). Each layer (or course) of hexagonal tubes and inserts shown at 1700 can be installed by this repeatable process.

Figure 18:
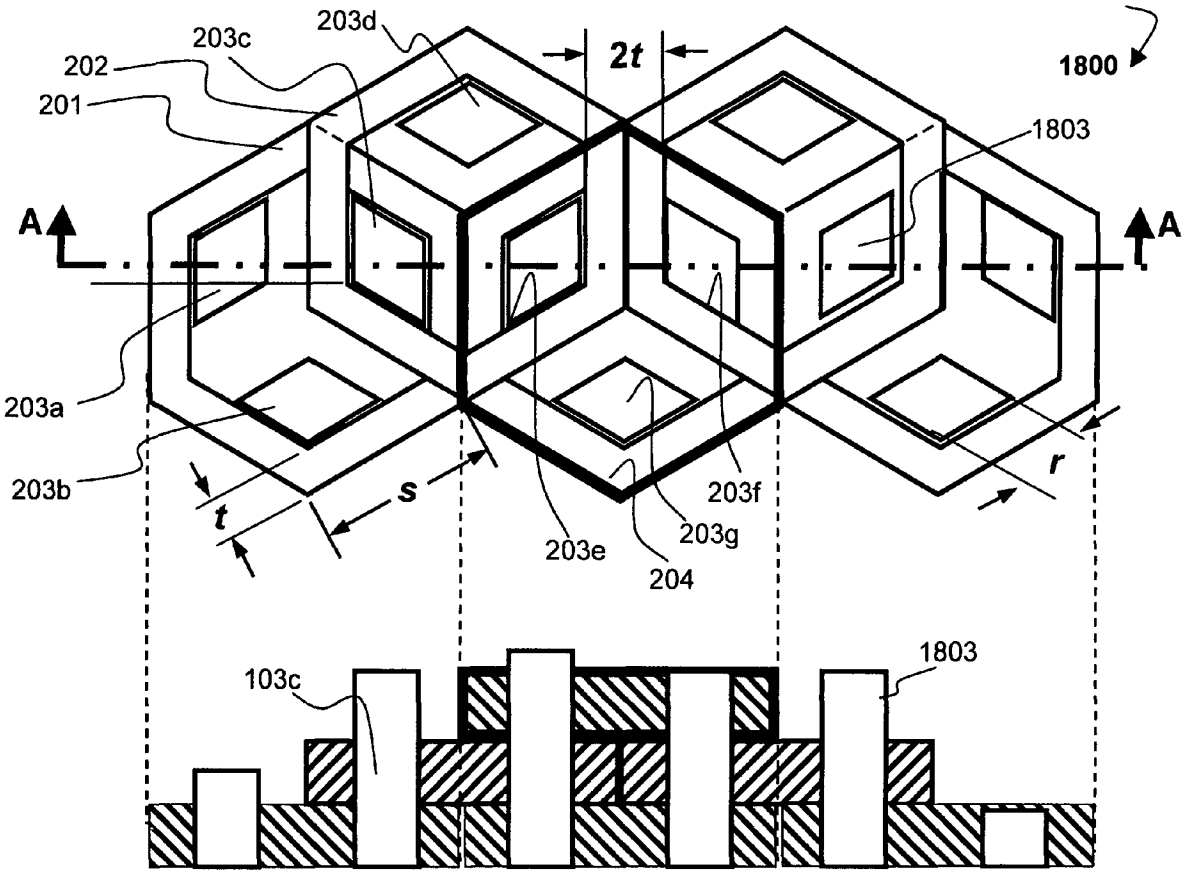
FIG. 18 is a top view and sectional view of FIG. 17.

Referring to FIG. 18, a combined top view and sectional view of FIG. 17 is shown. This graphically demonstrates the spaces that are common between aligned hexagonal tubes. It also shows the alignment of rhomboid inserts as they as reside at least partially inside one hollow of the first hexagonal tube 201 and at least partially inside one of the hollows of a second, non-collinear hexagonal tube 202. In a configuration such as this, a device in the form of a spacer element can be beneficial. A spacer element can be a tri-directional spacer or a granular filler material, or a web as described earlier in this disclosure. A spacer element can be anything else that fills the space between the rhomboid inserts inside of a hexagonal tube, capable of being understood by anyone skilled in the art.

Referring to FIG. 17 and FIG. 18, it is possible to address potential interference between adjacent walls of adjacent hexagonal tubes in several ways in a configuration like that shown at 1700. Some examples of solutions include:

- using rhomboid inserts made of a material with enough flexibility to bend as the inserts go between courses of tubes;
- having flexibility in the walls of the tubes;
- having walls on the tubes that are thin relative to the perimeter of the tubes; or
- providing a geometric feature in the inserts to compensate for the interference that would otherwise exist.

One example of a feature that could be added to the inserts would be a step in the external rhomboid profile. The inserts also might be formed to unfold in place or to expand when filler materials like expansive foam are placed inside them to solidify. There are many other ways to address this interference capable of being understood by anyone skilled in the art.

Figure 19:
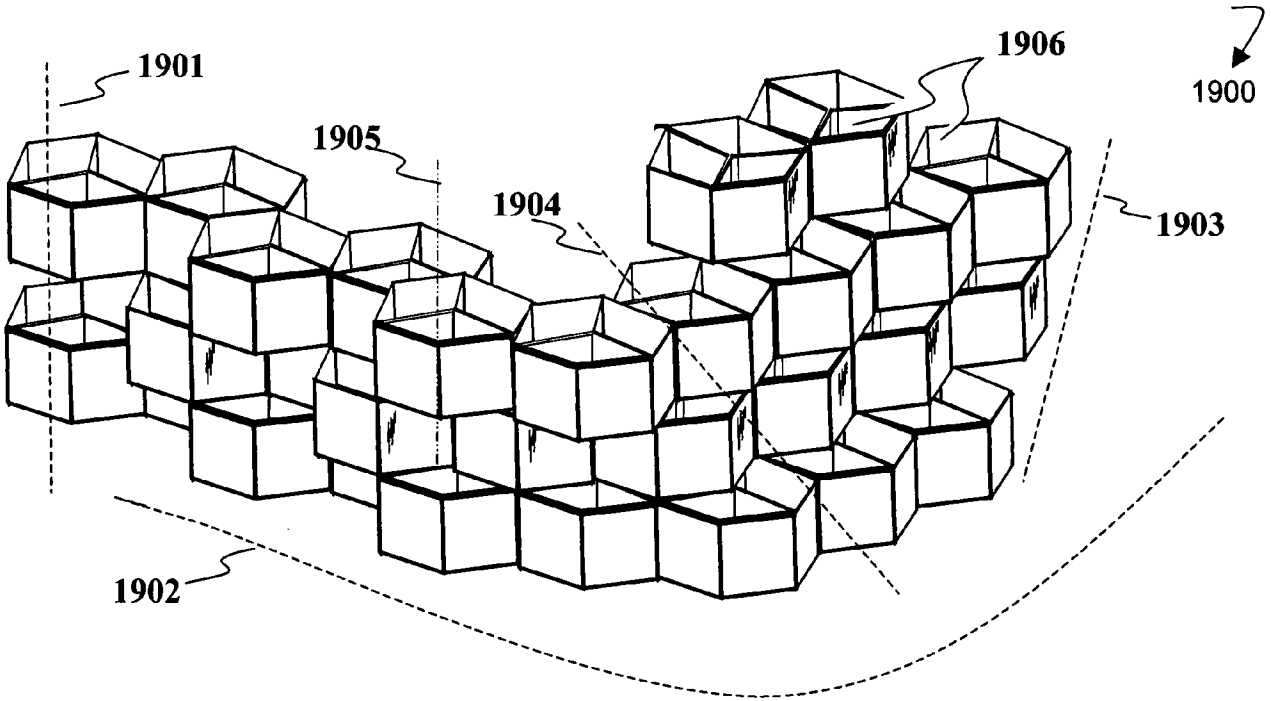
FIG. 19 is an isometric view of a wall comprised of more than 20 hexagonal tubes and associated inserts.

Referring to FIG. 19, an assembly of multiple hexagonal tubes having three levels is shown at 1900. This drawing illustrates an example of a large structure made from hexagonal tubes and rhomboid spacers. The region of this assembly aligned with line 1901 depicts a vertical face wall that presents a 'woven' look with each tube offset from adjacent tubes in a repeating in-and-out pattern. The tubes in this section also offer an open portion that is aligned and can be used for temporary bracing until the face wall is set and secured. A rhomboid insert used here can be of a length that the joints between these inserts are not visible between the tubes for aesthetic purposes. The assembly can change direction in order to fit behind a boundary line, shown at 1902. The assembly can change in layout configuration from a vertical face wall aligned with 1901 to a cascading "stair step' pattern is aligned with line 1904. The assembly can recede up an incline aligned with line 1903 and away from the front face aligned with line 1904. The relative positions of the two hexagonal inserts shown at 1906 illustrate a reversal of the pattern formed by the inserts inside the tubes.

Figure 20:
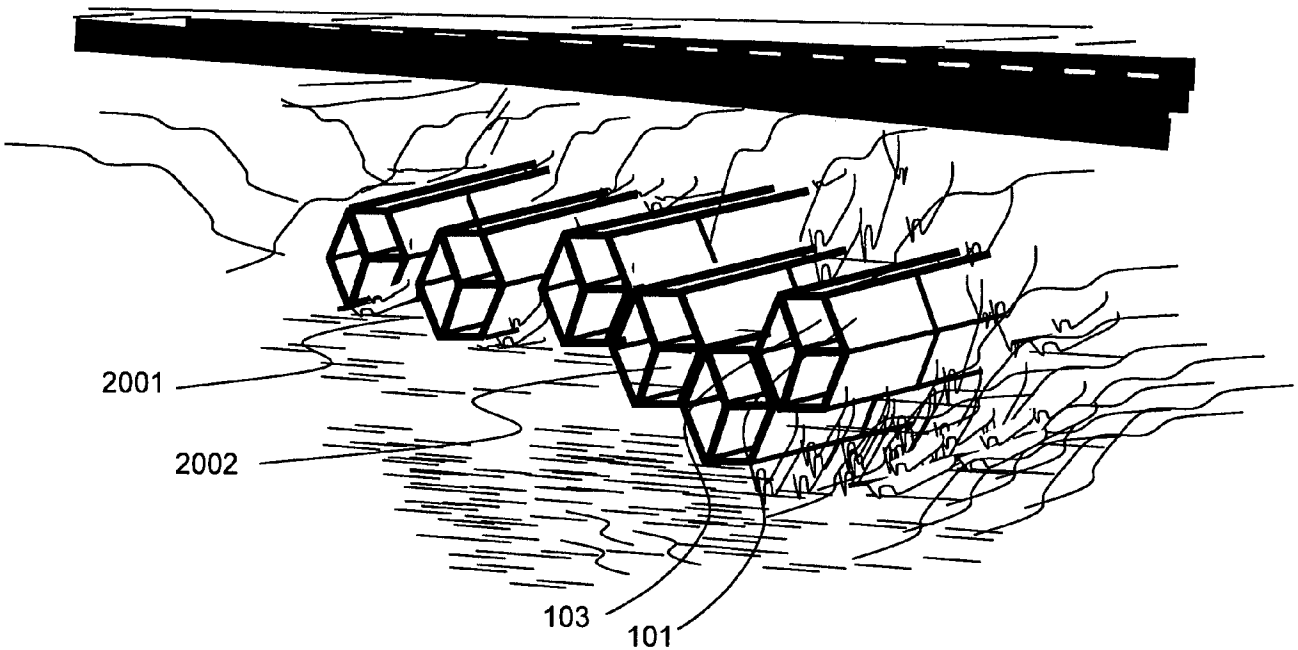
FIG. 20 is an isometric view of a culvert made from hexagonal tubes and rhomboid spacers in a horizontal configuration.

Referring to FIG. 20, the placement of hexagonal tubes laid down with their central axes in a substantially horizontal position is shown at 2001. In this case, both open ends of a tube are at approximately the same elevation. In the configuration shown at 2001, the ends of multiple tubes are contiguous to one another and the central axes of these tubes are collinear. In this embodiment, rhomboid inserts 103 are placed into hexagonal tubes and can provide structural support to the hexagonal tube 101. One means for implementing this embodiment uses rhomboid inserts 103 that are approximately two-thirds the effective horizontal length of a hexagonal tube 103 section for ease of installation as two segments. For interlocking is beneficial to always provide an extended portion that can concurrently occupy more than one hexagonal tube. A rigid spacer of the type shown in FIG. 9 or FIG. 11 may also be used to provide structural support. The hexagonal tubes can also use Also referring to FIG. 20, sets of collinear hexagonal tubes 101 can be placed adjacent to other sets of collinear hexagonal tubes in a horizontal orientation to create a continuous conduit that extends over any desired expanse. It is expected that multiple sets of hexagonal tubes can be lain beside and atop each other to increase the effective capacity of the installed conduit system 2002. In that instance, the collinear sets of hexagonal tubes 101 lain in a horizontal orientation will create a common wall interface between the resulting horizontal conduits as shown in 2002. Coupling and branching components can be utilized in this embodiment that are not depicted and are understood by anyone skilled in the art. Such coupling and branching components will conform to the dimensional attributes of the hexagonal tubes 101 and rhomboid inserts 103.

While the principles of the disclosure have been described above in connection with specific apparatuses and methods, it is to be clearly understood that this description is made only by way of example and not as limitation on the scope of the invention.

I claim:

1. A structure comprising:

a plurality of regular hexagonal tubes, wherein:

the tubes have central axes that are straight lines and parallel to each other, each of said tubes has at least one hollow, the tubes are open on both ends, the ratio of outside perimeter to wall thickness in at least one cross section perpendicular to the central axis of each tube that includes at least one of said hollows is greater than 27.7 to 1, and the tubes are placed end-to-end such that an end of a first of said tubes is contiguous to an end of a second of said tubes; and a minimum of five inserts, wherein:

each of said five inserts comprises a region having an exterior shape from a set of a 60/120 degree rhomboid prism and a 60/120 degree rhomboid cone, the exterior shapes of said inserts in said regions are similar to one another, the exterior shapes of said inserts in said regions are similar, the exterior shapes of said inserts in said regions are equal in size, said regions of three of said inserts are at least partially inside one of said hollows of said cross section of said first hexagonal tube, said region of one of said three inserts is at least partially inside one of said hollows of said cross section of said second hexagonal tube, said region of the two of said minimum five rhomboid inserts that are not at least partially inside one of said hollows of said first hexagonal tube are inside one of said hollows of said cross section of said second hexagonal tube, and the longitudinal axes of the inserts in said regions are parallel to each other and parallel to the central axes of the tubes.

2. The structure of claim 1 wherein the perimeter of said exterior shapes of the inserts when viewed perpendicular to the longitudinal axes of the inserts is no greater than:

$$2(6s)/3-8(t)/(3\sqrt{3})$$

where:

6s is the perimeter of the hexagonal tube in said cross section; and t is the thickness of the walls of the hexagonal tube in said cross section.

3. The structure of claim 1 wherein said hexagonal tubes are foldable and wherein said rhomboid inserts are foldable.

4. The structure of claim 1 wherein said hexagonal tubes comprise an open frame.

5. The structure of claim 1 wherein the central axes of said first and said second tubes are collinear.

6. The structure of claim 1 wherein the central axes of said first and said second tubes are not collinear.

7. The structure of claim 1 further comprising a spacer element wherein said spacer element fills a gap between said inserts in at least one of said tubes and wherein said spacer element is comprised of one from the set of a solid material, a free-flowing material, and a free-flowing material that has hardened after it has been placed inside said region.

8. The structure of claim 1 wherein at least one of said hexagonal tubes further comprises an internal web wherein said internal web fills a gap between said inserts.

9. The structure of claim 1 further comprising a third regular hexagonal tube wherein:

said third hexagonal tube is placed immediately adjacent to said first hexagonal tube and is placed end-to-end in an offset configuration relative to the second tube and at least part of a second of said rhomboid inserts is inside both of said second and third tubes; and where at least one additional constraint chosen from the following set is satisfied to address potential interference between the adjacent walls of the first and third regular hexagonal tubes:

the first and second inserts are made of a material with enough flexibility to bend as the inserts go between courses of tubes;

the walls of the tubes are flexible;

the walls of the tubes are very thin relative to the perimeter of the tubes; and the inserts have a geometric feature to compensate for the interference that would otherwise exist.

10. The structure of claim 1 further comprising a third, fourth, fifth, and sixth regular hexagonal tube and wherein said six hexagonal tubes are distributed across at least three layers and wherein said structure is suitable for use in a field chosen from the set of:

agriculture;
architecture;
civil engineering;
construction;
emergency management;
flood control;
horticulture;
land management;
land reclamation and recovery;
military defense;
mining;
ocean and sea management;
shorelines; and
water management.

11. The structure of claim 1 further comprising a third, fourth, fifth, and sixth regular hexagonal tube and wherein said six hexagonal tubes are distributed across at least three layers and wherein said structure is suitable for use in an application chosen from the set of:

barricades;
barrier reefs;
berms;
buildings;
bunkers;
culverts;
dams;
facades;
fencing;
fish ladders;
foundations;
jetties;
levees;
planters;
reinforcement walls;
retaining walls;
retention ponds;
revetments;
roadways;
sand dunes;
scaffolds;
seawalls;
shoring;
shorelines;
snow fences;
space stations; and
streambeds.

12. A process for on-site fabrication of a structure comprising the steps of:

establishing a minimum of two straight hollow open-ended regular hexagonal tubes wherein said tubes comprise equally-sized and shaped cross-sectional profiles;

establishing a minimum of five rhomboid-shaped inserts comprising equally-sized and shaped regions chosen from a set of a rhomboid cone and a rhomboid prism;

placing a first of said five rhomboid inserts into a first of said hexagonal tubes in a configuration such that:

the longitudinal axis in said region of said first insert is parallel to the central axis of said first tube;

at least one end of said first insert extends outside said first hexagonal tube, and two walls in said region of said first insert are adjacent to two of the interior walls of said first tube;

placing a second of said two hexagonal tubes over said exposed end of said first insert in a configuration such that:

the central axis of said second tube is parallel to the longitudinal axis in said region of said first insert and parallel to the central axis of said first hexagonal tube; and two walls in said region of said first insert are adjacent to two of the interior walls of said second tube;

placing a second and third of said rhomboid inserts into said first hexagonal tube in a configuration such that:

the central axis of said first tube and the longitudinal axes in said regions of said second and third inserts are parallel;

two walls in said region of said second insert are adjacent to two of the interior walls of said first tube;

two walls in said region of said third insert are adjacent to two of the interior walls of said first tube; and the longitudinal axes in said regions of said first insert, said second insert, and said third insert are not collinear;

placing a fourth and fifth of said rhomboid inserts into said second hexagonal tube in a configuration such that:

the central axis of said second tube and the longitudinal axes in said regions of said fourth and fifth inserts are parallel;

two walls in said region of said fourth insert are adjacent to two of the interior walls of said second tube;

two walls in said region of said fifth insert are adjacent to two of the interior walls of said first tube; and the longitudinal axes in said regions of said third insert, said fourth insert, and said fifth insert are not collinear.

13. The process of claim 12 wherein establishing rhomboid inserts further comprises solid rhomboid inserts.

14. The process of claim 12 wherein establishing rhomboid inserts further comprises cored rhomboid inserts.

15. The process of claim 14 further comprising the steps of filling said cores of said rhomboid inserts with a material chosen from the set of a solid material, a free-flowing material, and a free-flowing material that has hardened after it has been placed inside said core.

16. The process of claim 12 further comprising the steps of reconfiguring said rhomboid inserts from a collapsed state.

17. The process of claim 12 wherein establishing rhomboid inserts further comprises a space frame.

18. The process of claim 12 wherein establishing hexagonal tubes further comprises the step of reconfiguring said hexagonal tubes from a collapsed state.

19. A kit containing a minimum of two hollow hexagonal prisms and a minimum of five rhomboid inserts suitable for use in the fabrication of a structure that can be assembled on-site, wherein:

the prisms have central axes that are straight lines;

the ratio of outside perimeter to wall thickness in at least one cross section perpendicular to the central axis of each prism is greater than 27.7 to 1;

each of said five inserts comprises a region having an exterior shape from the a set of a 60/120 degree rhomboid prism and a 60/120 degree rhomboid-cone;

each of said five inserts has at least one section whose exterior shape and size is identical to that of the other of said inserts;

the perimeter of said sections of the inserts when viewed perpendicular to the longitudinal axes of the inserts is no greater than:

$$2(6s)/3-8(t)/(3\sqrt{3})$$

where:

6s is the perimeter of the exterior hexagon of the hexagonal prism; and t is the thickness of the walls of the hexagonal prism.

20. The kit of claim 19 further comprising a third hexagonal prism, a fourth hexagonal prism, a fifth hexagonal prism, and a sixth hexagonal prism wherein:

said hexagonal prisms are regular hexagonal prisms;

said hexagonal prisms are open on both ends;

said hexagonal prisms are capable of being tightly packed;

said rhomboid inserts are capable of being tightly packed; and said structure further comprises a spacer element.

* * * * *